United States Patent [19]

Geary et al.

[11] Patent Number: 4,540,637

[45] Date of Patent: Sep. 10, 1985

[54] PROCESS FOR THE APPLICATION OF ORGANIC MATERIALS TO GALVANIZED METAL

[75] Inventors: David F. Geary, Severna Park; Dennis R. Honchar, Ellicott City; Robert P. Miller, Annapolis, all of Md.

[73] Assignee: Baltimore Aircoil Company, Inc., Jessup, Md.

[21] Appl. No.: 398,517

[22] Filed: Jul. 15, 1982

Related U.S. Application Data

[63] Continuation-in-part of Ser. No. 221,176, Dec. 29, 1980, abandoned.

[51] Int. Cl.[3] ..... B05D 3/02

[52] U.S. Cl. ..... 428/626; 427/195; 427/406; 427/410; 428/418

[58] Field of Search ..... 427/27, 195, 309, 202, 427/406, 410; 428/418, 457, 626

[56] References Cited

U.S. PATENT DOCUMENTS

| | | | |
|---|---|---|---|
| 3,090,696 | 5/1963 | Gemmer | 427/185 |
| 3,674,445 | 7/1972 | Wlodek | 29/195 |
| 3,729,294 | 4/1973 | Hibbs | 428/626 |
| 3,999,957 | 12/1976 | Tongyai | 428/626 |
| 4,237,192 | 12/1980 | Ito et al. | 428/626 X |
| 4,305,343 | 12/1981 | Long | 427/195 |

FOREIGN PATENT DOCUMENTS

| | | | |
|---|---|---|---|
| 112731 | 9/1979 | Japan | 428/626 |
| 140551 | 11/1980 | Japan | 428/626 |
| 815756 | 7/1959 | United Kingdom | 427/309 |
| 1009055 | 11/1965 | United Kingdom | 427/195 |
| 1281767 | 7/1972 | United Kingdom | |

OTHER PUBLICATIONS

Corrosion Commentary, Anti-Corrosion, 10/1978, p. 3.

*Primary Examiner*—Shrive P. Beck

*Attorney, Agent, or Firm*—Charles E. Bouton; Edward J. Brosius

[57] ABSTRACT

This invention relates to a process for the application of organic materials, such as powders, to hot dip or electroplated galvanized metal which provides a finished material with a higher level of corrosion resistance than that obtained from organic coatings on mild or black steel. Because of the natural corrosion protection properties of the zinc cladding of galvanized metal, no additional passivation of the substrate is necessary as is required with existing processes on mild or black steel. Also, the invention relates to the hot dip or electroplated galvanized metal which has been pretreated by the process of this invention prior to application of an organic powder coating. Hot dip or electroplated galvanized metal treated by this process leads to a uniform coating which is virtually impervious to acid, basic and salt solutions, and which will not scratch or flake off on impact.

8 Claims, No Drawings

PROCESS FOR THE APPLICATION OF ORGANIC MATERIALS TO GALVANIZED METAL

REFERENCE TO RELATED APPLICATIONS

The instant case is a continuation-in-part of our previous filed application Ser. No. 221,176 entitled "Pretreatment Process for Galvanized Metal Prior to its Coating With Organic Powder" filed in the U.S. Patent & Trademark Office on Dec. 29, 1980 and now abandoned.

BACKGROUND OF THE INVENTION

As background to the invention, a general discussion of metal preparation for powder coating will be presented. This will lead into a comparison of conventional metal preparaton systems and the system of the present invention.

One skilled in the art would recognize that the prior art teaches that to achieve a goal of providing the ultimate corrosion protection of steel with an organic powder coating requires several steps be satisfied. First, the surface must be thoroughly cleaned of all dirt, oil, oxidation products and any other foreign matter. Second, sites to which the powder can bond must be available on the surface. These are generallv provided by depositing certain crystals on the surface during the preparation operations and/or by mechanically or chemically roughening the surface. Third, the coating must be specially formulated to impart corrosion resistant properties to the steel when applied in thin coatings generally less than 0.010 inches (0.25 mm).

Those expert in the area of such powder coatings recommend they be applied over mild or "black" steel. Sophisticated surface preparation systems for mild steel have been developed which typically include first cleaning the steel and sometimes roughening it, then rinsing it with a solution which deposits a microscopic layer of crystalline material, such as zinc phosphate. The purpose of this microscopic layer is to passivate the surface against corrosion and to provide bonding sites for the functional powder. Hot dip or electroplated galvanized steel (henceforth referred to as galvanized steel) normally is not recommended as the substrate, despite the superior resistance to corrosion provided by the zinc cladding, because experience has indicated that the organic powders do not bond as well to the inherently smooth zinc cladding as to properly prepared mild steel.

This is demonstrated in U.S. Pat. No. 3,674,445 (Wlodek) which teaches that both nonpretreated and conventionally pretreated hot dip or electroplated galvanized steel surfaces present adhesion problems. Wlodek found that an acceptable bond could be obtained only through the use of vacuum-vapor deposited zinc as a substrate, an exotic plating technique, not available commercially, which produces microscopically rough surfaces as compared to galvanized steel. As a result of this and similar investigations, it appears to have been concluded generally by those skilled in the art that galvanized steel does not constitute a viable substrate for achieving good adhesion of the organic powder coating to the substrate.

The difficulty in obtaining good coating adhesion with a relatively smooth substrate (such as galvanized steel) is demonstrated also by Gemmer (U.S. Pat. No. 3,090,696) and Wamant, et al., (British Pat. No. 815,756), both of which teach that coating adhesion is improved by roughening the surface prior to applying the coating. In fact, Wamant instructs to create "anchor cavities" in the surface to achieve good adherence. Banister (British Pat. No. 1,009,055) recommends blasting the surface to be coated with abrasive particles, such as steel shot, to clean the surface and, while not specifically stated, presumably to roughen it also.

An investigation leading to the subject invention concluded that it was not necessary to roughen galvanized steel prior to coating, as prior art would teach, in order to produce a bond between the coating and galvanized steel equivalent or superior to that obtainable with mild steel substrates. This means that it is possible to utilize galvanized steel as the substrate and thus realize an additional benefit from the superior corrosion resistance of the zinc cladding while still achieving the desired outstanding adhesion of the functional powder coating to the substrate.

A major advantage of the use of galvanized steel over mild steel as the substrate is realized where the powder coating becomes physically damaged, as can occur, for example, in shipping, rigging, or installing industrial equipment. In this situation, the corrosion resistance is determined only by the substrate material and the zinc cladding of the galvanized steel provides significantly greater corrosion protection than can be obtained through the use of a passivating rinse, as typically used on mild steel.

As further background to the invention, the currently used eight-stage or eight-step pretreatment process used by those skilled in the art to prepare hot dip or electroplated galvanized metal prior to coating with an organic powder will be described. The present invention which is an improved four-step pretreatment process will then be described. The eight-stage or eight-step pretreatment process is as follows:

Step 1—The first step cleans the zinc surface of the qalvanized metal substrate to remove any grease or dirt that is present. This is accomplished by washing or spraying the surface with an alkaline-type cleaning solution with its pH maintained so that it will not attack the zinc.

Step 2—A water rinse is applied to remove the alkaline cleaner from the substrate. Due to carryover of the alkaline cleaner from step 1, this rinse is a mild alkaline rinse.

Step 3—A second water rinse is utilized to remove any alkaline residues remaining on the surface following step 2. Thorough removal of all alkaline residues is important because the fourth step requires a delicate acid balance of a zinc phosphate solution. If any alkalinity is left on the substrate, it will affect the acid balance of the zinc phosphate solution.

Step 4—Substrate passivation, the key to the eight-step system, is accomplished by spraying a zinc phosphate solution on the substrate. This zinc phosphate solution reacts with the zinc substrate to produce and deposit water insoluble zinc phosphate crystals on the surface. It is imoortant that this zinc phosphate solution be maintained at a pH near 3 or a powdery precipitate will be deposited on the substrate. This precipitate is undesirable, as it will significantly reduce coating adhesion.

The zinc phosohate crystals formed on the surface of the substrate serve a two-fold purpose: to passivate the substrate and thereby provide some degree of corrosion protection and to provide irregular molecular sites to which the powder coating can mechanically bond.

Step 5—The fifth step is a water rinse which is necessary to remove excess zinc phosphate solution and any water soluble salts (chlorides, sulfates, or nitrates) that may be on the surface of the substrate. These water soluble salts should be removed from the surface or they will reduce adhesion of the coating.

Step 6—The sixth step is an acidified rinse using chromium compounds such as chromic acid. The primary purpose of this rinse is to remove the less soluble salts remaining after the water rinse in step 5. The chromium compound also deposits an additional barrier coat to give the substrate some added corrosion protection as well as filling some of the pores which exist in the zinc phosphate crystal film, thereby enhancing the passivation of the metal while providing additional molecular bonding sites for the powder coating.

Step 7—The seventh step of the pretreatment process is a water rinse whose purpose is to remove any foreign salts or minerals.

Step 8—The last step involves thoroughly drying the galvanized metal by the application of heat.

It should also be mentioned that in the prior art and in previous pretreatment processes for galvanized metal there is a so-called six-stage or six-step system. This system is similar to the eight-step system except that steps 3 and 7, which are respectively the two water rinse steps, are eliminated. Likewise, step four may also involve iron phosphate in place of zinc phosphate.

DESCRIPTION OF THE INVENTION

This invention comprises a process for applying organic powders to galvanized steel, which employ a four-step pretreatment process prior to its coating with the organic powder. This pretreatment process was specifically developed for application with a galvanized steel substrate, which does not require passivation to assure protection of the steel from corrosion.

It is an object of this invention to provide a pretreatment process for galvanized metal so that when coated with an organic powder, the adhesion of said coating will be superior to that possible with conventional pretreatment systems.

It is another object of this invention to provide a powder coating system for galvanized metal whereby the metallic zinc layer on the steel is utilized directly to provide a second barrier against corrosion of the base metal as well as to provide sacrificial corrosion protection for the metal rather than utilize less effective chemical rinses, such as a zinc phosphate rinse, to deposit a corrosion protective layer on the surface.

It is another object of this invention to provide a four-step process for pretreating galvanized metal prior to organic powder coating of said metal which process results in savings in material, time, and labor when compared to the prior art pretreatment processes.

It is another object of this invention to provide a pretreatment process for galvanized metal prior to the organic powder coating of said metal which uses no chrome compounds which are considered hazardous wastes.

It is a further object of this invention to provide a pretreatment system for galvanized metal which deposits no zinc phosphate on the metal unlike other systems which intentionally deposit significant amounts of zinc phosphate on the metal to passivate the metal and produce bonding sites for the organic powder coating. It has been concluded that by immediately organic powder coating the metal, the passivating effect of the zinc phosphate crystals is not required.

The four-step system of applicants' invention follows:

Step 1—The first step in the four-step pretreatment system of this invention is an acid etch cleaning which is defined as a process for removing grease, dirt and other contaminants without roughening the galvanized metal surface or without removing any significant amount of the protective zinc coating. It has been found that phosphoric acid is the preferred cleaning agent which in actual practice forms and randomly distributes small amounts of zinc phosphate crystals over the substrate surface but these do not contribute to the process.

Step 2—The second step is a water rinse, which is applied to remove excess cleaning solution from step 1, plus any salts (chlorides, nitrates, sulfates, and the like) that may be on the surface of the substrate. Due to acid carry-over from step 1, this rinse is normally a mild acid rinse.

Step 3—The third step is a water rinse which is utilized to fully remove any mild acid, salt, or mineral residues which remain on the surface following step 2. This step requires less time or equipment if the water is heated.

Step 4—The last step involves thoroughly drying the galvanized metal by the application of heat.

The following is a more detailed description of each of the above steps, including a detailed description of the methods for carrying out the steps.

The first step in the preparation of the galvanized metal for coating involves acid etch cleaning to assure a clean and oxide-free surface. This is accomplished through the use of a mild acid solution, particularly a typical biodegradable solution (liquid acid solution) containing phosphoric acid, solvents, and surfactants and which is obtainable commercially in various formulations from, for example, Oakite Products, Inc., in Berkeley Heights, N.J. It is formulated for removing light grease, shop dirt, welding fluxes, oxides, and mill scale from the galvanized metal. Such cleaning is accomplished without roughening the galvanized metal and without removing significant quantities of the zinc coating. Since the preferred mild acid cleansing agent contains phosphoric acid, a small amount of zinc phosphate crystals, resulting from the chemical reaction of the phosphoric acid with the zinc, are randomly distributed over the surface substrate of the metal but these do not contribute to the precleaning process. Typically a 3-20% solution by volume of this mild acid compound at 75°-100° F. is used. The exact temperature and concentration must be adjusted to achieve thorough cleaning with minimal attack of the zinc. The solution is usually contained in a vat which is large enough so that the entire piece of galvanized metal can be dipped therein. It has been found that the minimum dipping time in this solution is 1½ to 3½ minutes with more time needed if the galvanized metal is heavily contaminated with dirt or oil or has been treated with special rinses by the metal vendor. Sometimes, instead of dipping, the cleaning and etching solution is sprayed onto the galvanized metal.

The secohd step involves a water rinse which is required to remove excess cleaning agent from step 1 plus any salts, such as chlorides, nitrates, or sulfates which may be on the surface of the substrate. Typically, tap water is used, but in areas where it contains high mineral levels, deionized water may be more suitable.

Water used in this step becomes slightly contaminated with the acidic cleansing agent used in step 3 as a result of carry-over of the cleansing agent on the surface of the galvanized steel.

Step 3 also involves a water rinse. As stated previously, this water rinse is required to assure that all of the dilute cleaning agent, plus any salts minerals remaining on the surface following step 2, are removed.

In step 4, the treated galvanized metal must be dried prior to its coating with the organic powder. This drying is usually done by inserting the pretreated and rinsed galvanized metal into an oven at 130°–400° F. for approximately 2 to 10 minutes so that it thoroughly dries. A preferred typical condition would be inserting the pretreated and galvanized metal in the oven at 250° F. for approximately 5 minutes.

Upon completion of the four-step pretreatment process, the galvanized metal must be powder coated within a short period of time or at least before any significant amount of zinc oxide develops on the galvanized metal as a result of exposure to the atmosphere or other oxidizing agents. This is so because unlike conventional pretreatment systems, no passivation coating is deposited in the instant invention. Ideally, then the galvanized metal should be powder coated immediately after it has been dried. As a practical matter, however, due to equipment limitations and location, manpower requirements, moving needs, and the like, it has been found that the time between drying (step 4) and application of the organic powder coating to the galvanized metal can range from about 5 minutes to 6 hours with an average time lag of about 10 minutes. Although 6 hours has been stated as an upper limit, this is an approximation, since it has been determined that if 2 or 3 days elapse between dry-off (step 4 of this invention) and powder coating, the adhesion of the coating will not be as good as if the time lag were 5 minutes to 6 hours. Importance of lag time on coating adhesion will vary with exposure of the galvanized metal to temperature and humidity conditions (i.e., inside a building storage or outside storage and the like).

The coating to be used is a typical organic powder such as, for example, epoxy, polyester, acrylics, or hybrids. Such products which have been used with great success in the instant invention are epoxy coating powders such as Pulvalure ®, Scotchkote ®, Corvel ®, or Vedoc ®, which are manufactured by and available from various suppliers. These typical epoxy coating powders are homogenous, melt-mixed, 100% solids designed for application to metals.

The organic powder coating is applied typically by electrostatic spray although it can also be applied by dipping the treated, rinsed, and dried galvanized metal into a fluidized bed of this powder. When applied by an electrostatic spray, the powder issues from a gun which imparts it with an electrically positive charge. Since the galvanized metal is negatively charged, the powder is attracted and caused to adhere to the metal. The particular thickness of the coating is not critical, although a typical thickness which has been found to be ideal is 0.004 inches (0.1 millimeters) ±0.001 inches (0.0254 millimeters). This is the approximate thickness which is deposited on the pretreated, rinsed, and dried galvanized metal before putting it in an oven for curing. Proper curing involves baking the powder coated metal in an oven at approximately 300°–550° F. for about 1–20 minutes. Temperatures and curing times are usually given by the manufacturer of the organic powder used.

Having thus described the invention with particular reference to the preferred forms thereof, it will be obvious to those skilled in the art to which the invention pertains, after understanding the invention, that various changes and modifications may be made therein without departing from the spirit and scope of the invention and defined by the claims appended hereto. Such modifications would include but not be limited to the use of organic materials in other than powder forms such as liquid forms.

What is claimed is:

1. A process for coating hot dip or electroplated galvanized metal consisting of: acid etch cleaning without roughening the galvanized metal and without depositing significant amounts of crystalline bonding sites on said galvanized metal by contacting the galvanized metal with a dilute acid solution; thoroughly rinsing said metal: drying said metal applying within 6 hours of drying a homogenous organic resin powder coating consisting of epoxy, polyester or acrylic and hybrid resins thereof of a thickness of at least 0.003 inches on the essentially zinc oxide free galvanized metal and then curing said organic resin powder coated metal at an elevated temperature to produce a virtually impervious uniform coating.

2. The process of claim 1 wherein the acid etch cleaning solution contains phosphoric acid, solvents, and surfactants.

3. Organic resin powder coated galvanized steel wherein the organic powder coating is applied according to the process of claim 2.

4. The process of claim 1 wherein the organic powder is an epoxy.

5. Organic resin powder coated galvanized steel wherein the organic powder coating is applied according to the process of claim 4.

6. The process of claim 1 wherein the rinsing of said metal consists of two water rinses.

7. Organic resin powder coated galvanized steel wherein the organic powder coating is applied according to the process of claim 6.

8. Organic resin powder coated galvanized steel wherein the organic resin powder coating is applied on galvanized steel pretreated according to the process of claim 1.

* * * * *

UNITED STATES PATENT AND TRADEMARK OFFICE

CERTIFICATE OF CORRECTION

PATENT NO. : 4,540,637

DATED : September 10, 1985

INVENTOR(S) : David F. Geary etal

It is certified that error appears in the above-identified patent and that said Letters Patent is hereby corrected as shown below:

Column 2, line 61, "imoortant" should read -- important --.

Column 4, line 63, "secohd" should read -- second --.

Column 5, line 2, "3" should read -- 1 --.

Signed and Sealed this

*Second* Day of *September 1986*

[SEAL]

*Attest:*

DONALD J. QUIGG

*Attesting Officer*

*Commissioner of Patents and Trademarks*